United States Patent [19]

Pruden

[11] Patent Number: 4,671,331

[45] Date of Patent: Jun. 9, 1987

[54] COVER FOR MEDICINAL VIAL

[75] Inventor: James F. Pruden, Orlando, Fla.

[73] Assignee: Lyphomed, Inc., Melrose Park, Ill.

[21] Appl. No.: 839,435

[22] Filed: Mar. 13, 1986

[51] Int. Cl.[4] ..... B65B 3/04

[52] U.S. Cl. ..... 141/98; 141/125; 141/330; 215/100.5; 215/DIG. 3; 222/108; 604/415

[58] Field of Search ..... 222/108, 490; 141/19, 141/329, 330, 85–92, 382–386, 286, 115–127, 98; 604/411, 414, 415, 198, 192, 201, 253; 215/DIG. 3, 100 R, 100.5

[56] References Cited

U.S. PATENT DOCUMENTS

| | | | |
|---|---|---|---|
| 1,189,465 | 7/1916 | Mayo | 604/415 |
| 2,186,888 | 1/1940 | Tullar et al. | 215/38 |
| 2,364,126 | 12/1944 | Cantor et al. | 215/43 |
| 2,524,365 | 10/1950 | Smith | 128/272 |
| 2,577,780 | 12/1951 | Lockhart | 128/220 |
| 2,653,609 | 9/1953 | Smith | 128/272 |
| 2,818,864 | 1/1958 | Hudson | 128/272 |
| 3,136,440 | 6/1964 | Krug et al. | 215/47 |
| 3,146,806 | 9/1964 | Ginsburg | 141/110 |
| 3,905,368 | 9/1975 | Lewis, Jr. et al. | 128/272 |
| 4,089,432 | 5/1978 | Crankshaw et al. | 215/6 |
| 4,187,893 | 2/1980 | Bujan | 150/8 |
| 4,465,200 | 8/1984 | Percarpio | 215/247 |
| 4,524,809 | 6/1985 | Dent | 141/1 |
| 4,564,054 | 1/1986 | Gustavsson | 141/383 |

*Primary Examiner*—Houston S. Bell, Jr.

*Attorney, Agent, or Firm*—Fitch, Even, Tabin & Flannery

[57] ABSTRACT

A medicinal vial cover for preventing the introduction of a liquid solution to atmosphere during the removal of the solution from a container of the type having an axially-extending neck and an entrance opening coaxial with the neck in which the opening is sealed by a rubber plug through which a hypodermic needle is inserted to extract the solution into a syringe, the cover having a tip at one of its ends and a hollow base at its other end adapted to be attached over the neck of the container. A hypodermic needle can then be inserted through both the cover and the rubber plug to withdraw the solution into a syringe with any aerosol or droplets being trapped within the cover.

5 Claims, 4 Drawing Figures

COVER FOR MEDICINAL VIAL

BACKGROUND OF THE INVENTION

This invention relates to covers for medicinal vials and more particularly to a cover which protects personnel from exposure to toxic chemicals or other substances when a solution is removed from the vial with a hypodermic needle.

In recent years the usage of antineoplastic drugs and other cytotoxic agents have increased considerably. Evidence exists showing that direct contact with or inhalation of aerosols created during the preparation and administration of antineoplastic drugs can produce effects such as dizziness, nausea, headache, and dermatitis. Concentrated solutions of antineoplastic drugs are known to be extremely irritating to the skin and mucous membranes. Concern has developed over the possibility that repeated, chronic exposure to small amounts of cytotoxic drugs will have long-delayed carcinogenic or teratogenic effects among hospital personnel who prepare and administer these drugs.

The removal of cytotoxic agents from medicinal vials is accomplished by inserting a hypodermic needle through a rubber plug which seals the mouth of the vial. The solution is then withdrawn into the syringe and the needle is removed from the rubber plug. Thus, the removal of cytotoxic agents from a medicinal vial is similar to the removal of any hypodermic solution contained within a medicinal vial. When a needle is inserted into a vial, air is generally introduced to create a positive pressure in the vial. When the needle is removed after withdrawing solution into the syringe, there can be an aerosol of the solution. Moreover, when extracting the solution, droplets are frequently left on the top surface of the rubber plug and therefore exposed to atmosphere.

In U.S. Pat. No. 4,465,200, Percarpio discloses a composite closure arrangement provided for evacuated blood collection tubes for reducing exposure of the operator to blood droplets or blood aerosol during removal of a sample of the blood from the container. In that patent, a cap is configured to be placed over and fitted onto the rubber stopper of the evacuated tube with the cap extending over and spaced from the top of the stopper to define a cavity between the overlying portion of the cap and the top of the stopper. The center of the cap includes a needle access bore providing access to the stopper. Removal of the blood is accomplished by a hypodermic needle which passes through the bore in the top of the cap and penetrates the stopper which is generally made of a self-sealing elastomeric material. As the needle penetrates the stopper, blood aerosol frequently sprays through the aperture formed by the needle. The purpose of the cap is to prevent the aerosol from spraying at the operator. However, nothing prevents the aerosol from spraying through the receiving bore, and into the atmosphere. Generally, after the solution has been extracted from the vial with the syringe the operator releases a portion of the solution from the syringe to remove any air bubbles as well as providing the proper dosage level in the syringe. The patent to Percarpio does not address the problem of preventing this released solution from being introduced to the atmosphere.

Other patents pertaining to closures for medicinal vials include U.S. Pat. No. 1,189,465 to Mayo; U.S. Pat. No. 2,186,888 to Tullar et al; U.S. Pat. 2,364,126 to Cantor et al; U.S. Pat. No. 2,524,365 to Smith; U.S. Pat. No. 2,524,607 to Smith: U.S. Pat. No. 2,577,780 to Lockhart; U.S. Pat. No. 2,653,608 to Smith; U.S. Pat. No. 2,818,864 to Hudson; U.S. Pat. No. 3,136,440 to Krug et al; U.S. Pat. No. 3,146,806 to Ginsburg; U.S. Pat. No. 3,905,368 to Lewis et al; U.S. Pat. No. 4,089,432 to Crankshaw et al; U.S. Pat. No. 4,187,893 to Bujan; and U.S. Pat. 4,524,809 to Dent.

SUMMARY OF THE INVENTION

The present invention teaches a disposable sterile elastic cover which fits snugly over a medicinal vial opening having a piercable rubber plug. The covering creates a sterile chamber to capture droplets and aerosols generated during the preparation of hypodermic solutions such as cytotoxic drugs. Extraction of the solution from the vial is accomplished by a hypodermic needle which penetrates both the cover and the rubber plug to communicate with the solution. Any aerosol caused by the insertion or removal of the needle remains within the chamber formed by the cover. Additionally, any drops on the outside of the rubber plug are also kept within the chamber. In order to eliminate any air bubbles within the syringe as well as removing any excess solution to provide the proper dosage, a portion of the solution is released from the syringe. With cytotoxic drugs and many other toxic solutions, it is desireable to avoid releasing such solutions into the environment and avoid skin contact. With the present invention, any excess solution can be injected through the cover and into the chamber defined by the cover. Thus, risk to persons working with cytotoxic and other hazardous drugs can be greatly reduced with the present invention.

In a preferred embodiment of the present invention the cover comprises a pierceable self-sealing nipple made of an elastomeric material having a tip at one of its ends and a hollow base at its other end. The base has an aperture adapted to fit over the neck of the medicinal vial. Additionally, an annular flange, made of an elastomeric material protrudes outwardly from the aperture. The flange allows the cover to be easily attached to the vial by permitting the user to grasp the flange and pull the cover onto the vial.

BRIEF DESCRIPTION OF THE DRAWINGS

The foregoing and other objects, features and advantages of the invention will become more apparent by reference to the accompanying drawings and the following detailed description taken in conjunction with accompanying drawings in which.

DESCRIPTION OF THE PREFERRED EMBODIMENT

Figure 1:
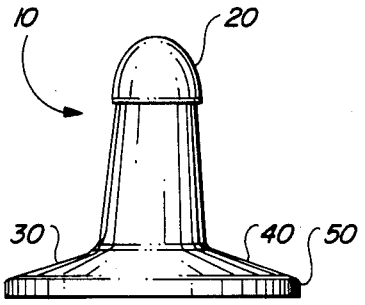
FIG. 1 is a plan view of a cover in accordance with the preferred embodiment.
Figure 2:
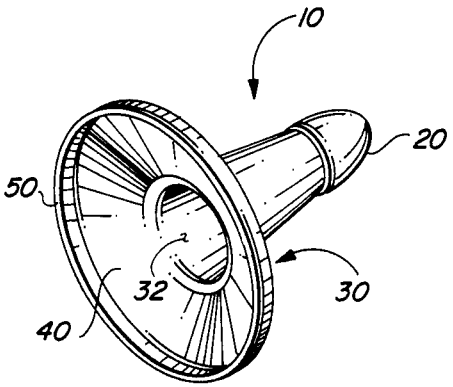
FIG. 2 is a perspective view of a cover in accordance with the preferred embodiment.

Reference is first made to FIGS. 1 and 2 which illustrate a cover 10 in accordance with the preferred embodiment. The cover 10 is in the form of a nipple having a tip 20 at one of its ends and a hollow base 30 at its other end. The base 30 includes an aperture 32 and an annular flange 40 protruding outwardly from the aperture 32. An optional rim 50 protrudes from the edge of the flange 40. Preferably, the tip 20 is thicker than the rest of the cover 10 to insure it is self-sealing when the tip 20 is punctured by a needle. In the preferred embodiment, the cover 10 is made of an elastomeric material such as latex. Additionally, the cover 10 is preferably transparent to enable visual observation of the needle, and any solution within the cover.

The cover 10 is preferrably manufactured by dip forming. In this technique, a form shaped to the dimensions desired of the cover is first constructed. The form is dipped into a fluent elastomeric substance, which substance adheres to the form in a suitably thin layer. The form is removed from the substance and the substance allowed to harden in situ. The tip 20 of the cover 10 may be dipped more than one time into the substance so that the tip 20 will be thicker than the rest of the cover 10, and thus provide a greater tension about a needle to minimize any opportunity for leakage.

Figure 3:
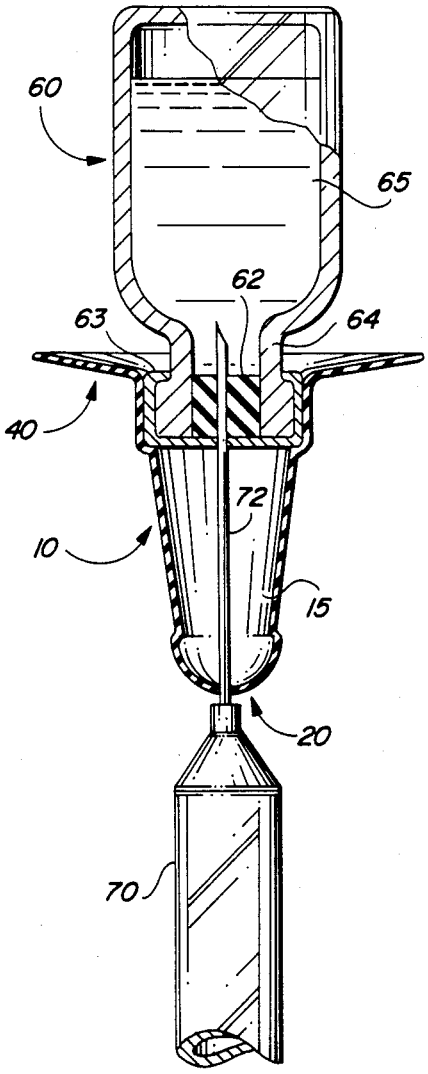
FIG. 3 illustrates a medicinal vial with a cover attached thereto and a syringe extracting a solution.

Reference is now made to FIG. 3 which illustrates a cover 10 in accordance with the preferred embodiment attached to a medicinal vial 60. The cross-sectional view of FIG. 3 clearly shows that the tip 20 is thicker than the rest of the cover 20. The medicinal vial 60, well known in the art, has an axially-extending neck 64 and an entrance opening coaxial with the neck 64. A rubber resiliant plug 62 is provided at the entrance opening of the vial 60 and is held in place with an aluminum seal 63. The flange 40 aides the user in attaching the cover 10 to the vial 60 by permitting the user to grasp the flange 40 and pull the cover 10 onto the vial 60. The aperture 32 is readily stretched to fit snugly over the neck 64 of the vial 60 to provide a leak-proof seal.

In use, a hypodermic needle 72 attached to a syringe 70 penetrates both the tip 20 of the cover 10 and the vial rubber plug 62. Air is then injected by the syringe 70 into the vial 60 to increase the internal pressure of the vial so that a solution 65 within the vial 60 can be easily extracted. Any aerosol caused by extracting the hypodermic needle 72 from the vial rubber plug 62 is contained within a chamber 15 defined by the cover 10 and the rubber plug 62. The aperture formed by the needle 72 penetrating the rubber plug 62 momentarily remains open after the needle 72 is removed from the rubber plug 62. Frequently, droplets and aerosols from the solution pass through the aperture and are introduced to the outside face of the rubber plug 62 before the aperture can close. With the cover 10 in place, these droplets and aerosols remain contained within the chamber 15.

Figure 4:
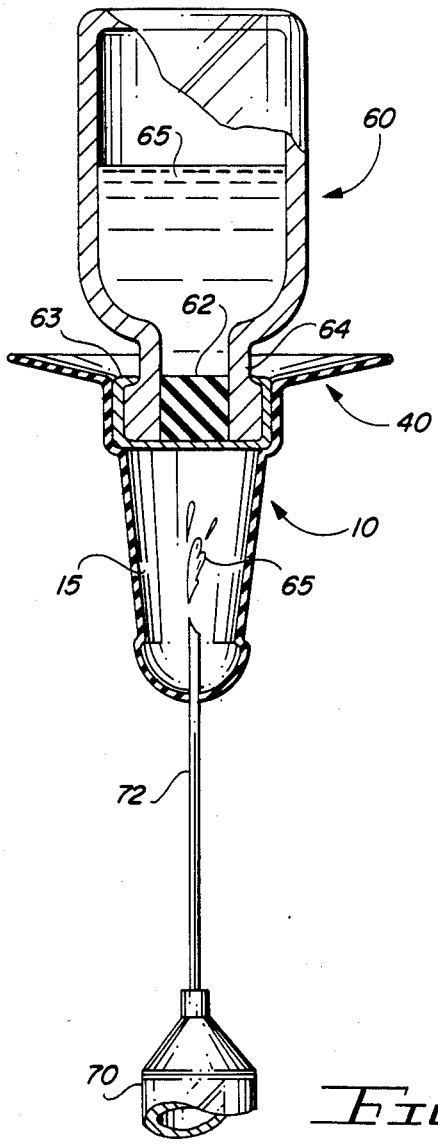
FIG. 4 illustrates a syringe expelling solution into the chamber within the cover of FIG. 3.

Reference is now made to FIG. 4 which illustrates the removal of air and a portion of the solution 65 from the syringe 70. With the tip of the needle 72 removed from the vial rubber plug 62 yet still contained within the chamber 15, a small portion of the solution 65 is expelled from the syringe into the chamber to remove any air bubbles as well as excess solution 65 from the syringe. The solution 65 is contained within the chamber 15 and is not introduced into the atmosphere. Thus, risk to the operator is greatly reduced.

While the principals of the invention have now been made clear in an illustrative embodiment, there will become obvious to those skilled in the art many modifications in structure, arrangement, portions and materials used in the practice of the invention and otherwise which are particularly adapted for specific operating requirements without departing from those principals. The appended claims are therefore intended to cover and embrace any such modifications, within the limits only of the true spirit and scope of the invention.

I claim:

1. A one-piece cover for use with a medicinal vial having an axially-extending neck and a sealed entrance opening coaxial with the neck adapted for puncturing by a needle of a syringe to permit withdrawal of the contents of said vial, said cover being formed of elastomeric material and comprising:

a pierceable, self-sealing nipple;

a flange adapted for grasping by the user to pull said cover over the neck of said vial; and a generally tubular intermediate portion interconnecting said nipple and said flange, said intermediate portion having internal dimensions throughout its length smaller than corresponding external dimensions of said neck so that said cover can be pulled over said neck causing said intermediate portion to expand to receive and hold said neck whereby, with said cover installed on said vial with said flange adjacent said neck, said nipple is spaced from the entrance opening of said vial and forms therewith, along with said intermediate portion, a chamber for containing matter such as droplets and aerosols occasioned by removal of said needle from said entrance opening.

2. A one-piece cover as set forth in claim 1 wherein said intermediate portion, in its as-formed condition, is substantially frustoconical, diverging from said nipple to said flange whereby said neck can be moved further into said intermediate portion only with increasing difficulty to effectively limit the extent of insertion of said neck into said portion.

3. A one-piece cover as set forth in claim 1 wherein said cover is of homogeneous composition.

4. A one-piece cover as set forth in claim 3 wherein said cover is made of transparent latex and manufactured by dip-forming.

5. A one-piece cover as set forth in claim 1 wherein said nipple has a greater wall thickness than other components of said cover.

* * * * *

UNITED STATES PATENT AND TRADEMARK OFFICE

CERTIFICATE OF CORRECTION

PATENT NO. : 4,671,331

DATED : June 9, 1987

INVENTOR(S) : James F. Pruden

It is certified that error appears in the above-identified patent and that said Letters Patent is hereby corrected as shown below:

Column 3, line 1, change "flange -40" to --flange 40--.

Signed and Sealed this

Twenty-seventh Day of October, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,671,331

DATED : June 9, 1987

INVENTOR(S) : James F. Pruden

It is certified that error appears in the above-identified patent and that said Letters Patent is hereby corrected as shown below:

Column 4, line 24, after "the" insert --fingers of the--.

This certificate supersedes Certificate of Correction issued October 27, 1987.

Signed and Sealed this

Sixteenth Day of February, 1988

*Attest:*

*Attesting Officer*

DONALD J. QUIGG

*Commissioner of Patents and Trademarks*